US007808337B2

(12) United States Patent
Rosenberg et al.

(10) Patent No.: US 7,808,337 B2
(45) Date of Patent: Oct. 5, 2010

(54) T-SHAPE WAVEGUIDE TWIST-TRANSFORMER

(75) Inventors: Uwe Rosenberg, Backnang (DE); Ulrich Mahr, Backnang (DE)

(73) Assignee: Ericsson AB, Stockholm (SE)

( * ) Notice: Subject to any disclaimer, the term of this patent is extended or adjusted under 35 U.S.C. 154(b) by 163 days.

(21) Appl. No.: 12/094,049

(22) PCT Filed: Nov. 14, 2006

(86) PCT No.: PCT/EP2006/068437

§ 371 (c)(1),
(2), (4) Date: Jun. 5, 2008

(87) PCT Pub. No.: WO2007/057389

PCT Pub. Date: May 24, 2007

(65) Prior Publication Data

US 2008/0238580 A1 Oct. 2, 2008

(30) Foreign Application Priority Data

Nov. 17, 2005 (GB) ..... 0523407.5

(51) Int. Cl.
*H01P 1/02* (2006.01)
*H01P 1/165* (2006.01)

(52) U.S. Cl. ..... 333/21 A; 333/33

(58) Field of Classification Search ..... 333/21 A, 333/21 R, 248, 33
See application file for complete search history.

(56) References Cited

U.S. PATENT DOCUMENTS 2,975,383 A * 3/1961 Seling ..... 333/21 A
5,111,164 A 5/1992 De Ronde
2002/0021184 A1* 2/2002 Rosenberg et al. ..... 333/125
2004/0246062 A1 12/2004 Asao et al.

FOREIGN PATENT DOCUMENTS

| | | |
|---|---|---|
| CA | 2 320 667 | 3/2001 |
| DE | 40 02 496 | 1/1991 |
| EP | 1 178 560 | 2/2002 |
| WO | 2005/034278 | 4/2005 |

OTHER PUBLICATIONS

International Search Report issued in PCT/EP2006/068437 on Feb. 16, 2007.

* cited by examiner

*Primary Examiner*—Benny Lee
(74) *Attorney, Agent, or Firm*—Coats & Bennett, P.L.L.C.

(57) ABSTRACT

A junction for connecting two waveguides having substantially a 90-degree angular offset between longitudinal symmetry axes of their cross-sections. The junction has a first interface and a second interface for connecting the waveguides, and at least a first transformer section and a second transformer section, both having cross-sections of substantially rectangular shape, and both having the 90-degree angular offset between longitudinal symmetry axes of their cross-sections. The first and second transformer sections are connected such that a T-shape connection is formed and the first transformer section has a first protruded ridge on its broad wall and the second transformer section has a second protruded ridge on its broad wall. The broad wall with the second ridge is connected to the top narrow wall of the first transformer section and the ridges are located such that they overlap.

14 Claims, 3 Drawing Sheets

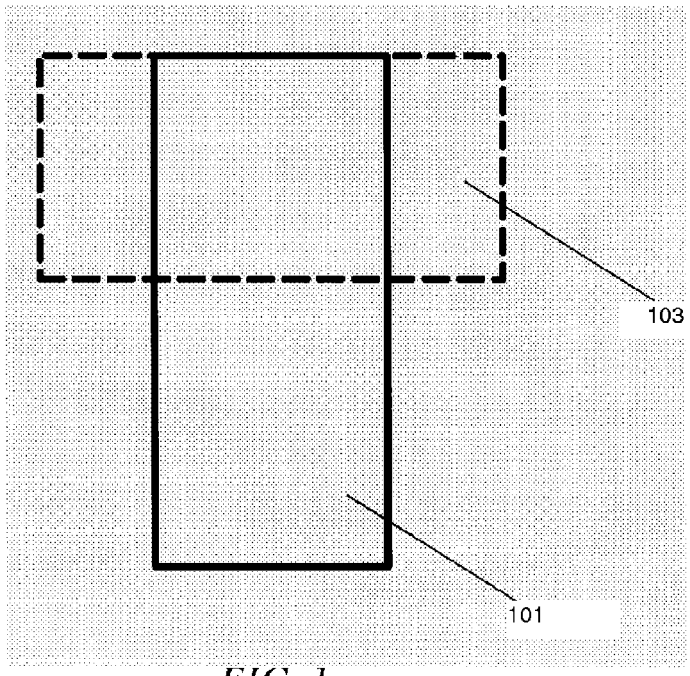
*FIG. 1*
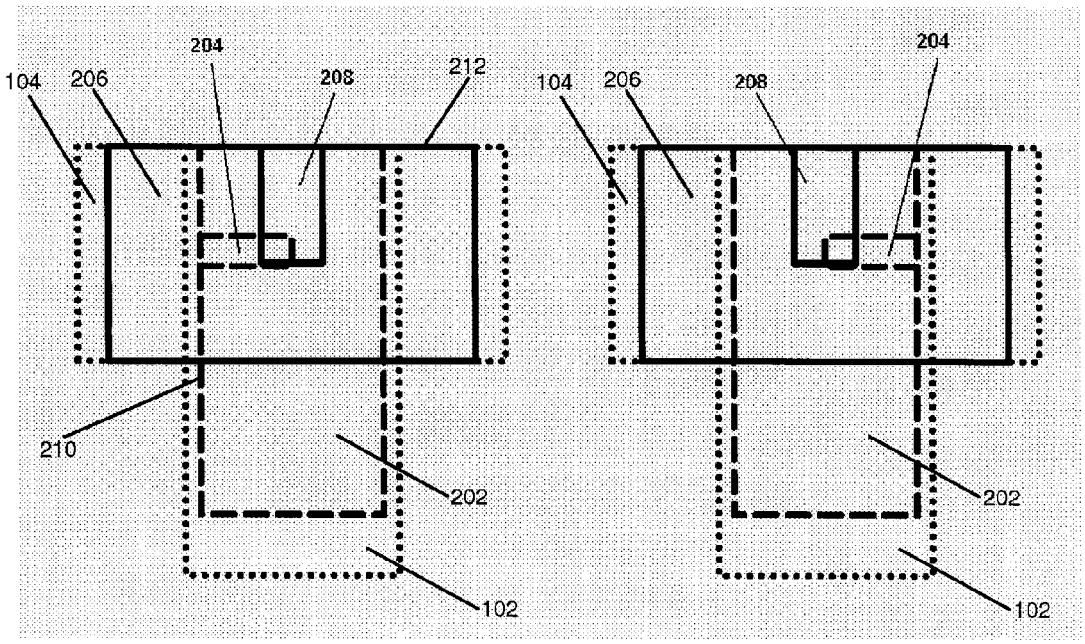
*FIG. 3A* *FIG. 3B*

T-SHAPE WAVEGUIDE TWIST-TRANSFORMER

FIELD OF THE INVENTION

The present invention relates to a waveguide junction also known as waveguide twist-transformer for connection waveguides that exhibit a 90-degree angular offset.

BACKGROUND

Waveguide twists are used to rotate the field orientation for matching two waveguides exhibiting an angular offset. In solutions known in the art the vector of the electric field is rotated in intermediate waveguide sections with appropriate angular steps from the input to the output waveguide. Each angular step gives rise to a partial reflection of the wave depending on the angular increment. In a proper design, these partial reflections should cancel at the center frequency; therefore the length of each section is favorably in the order of a quarter waveguide wavelength (or an odd multiple thereof). The overall bandwidth depends on the number of waveguide sections.

State-of-the-art waveguide twists are commonly based on step-twist sections, as is introduced, for example, in Wheeler, H. A., et al., "Step-twist waveguide components", IRE Trans. Microwave Theory Tech., vol. MTT-3, pp. 44-52, October 1955. To adapt the interconnection of two interface waveguides with a T-shape alignment (i.e. 90-degree angular offset), this solution can be modified considering, in addition to the angular offset between the intermediate steps, an offset along the cross section axis of one of the interfacing waveguides. A suitable realization of this design in one piece is possible by machining the structure from the flange faces with state-of-the-art CNC milling techniques. However, such a design is only possible for no more than two transformer steps, which yields substantial limitations for the achievable performance (i.e., Voltage Standing Wave Ratio, VSWR, and bandwidth). The length of the component is determined by the frequency band, i.e. the length of each transformer step is at a quarter waveguide wavelength of the center frequency of the operating band. Another drawback of the prior art solutions results from the fact that this solution would commonly exhibit an angular offset at the flange interconnections (interfaces). In consequence a specific (i.e. non-standard) flange sealing is necessary when using this component in sealed (pressurized) waveguide systems.

Alternative solutions known in the art are those consisting of two parts that have to be connected to form a fully functional junction. The two part format of these junctions allows for more complicated machining and, in consequence, achieves improved performance. However, the manufacturing of such junctions is complicated, expensive and time consuming. If two (or more) parts are used, they need to be combined in an appropriate way, which increases the manufacturing effort and expense. They could be assembled by screws—but such a solution needs additional sealing means in the parting plane if the component is used in a pressurized waveguide system. Another approach could entail assembling the parts by soldering or brazing—however, such solutions need the careful choice of the basic (and surface) material and the overall construction to accommodate the requirements of the additional process. Moreover the realization of the component from two (or more) parts yields additional tolerances (e.g., fitting of the parts) that may impair the optimal performance.

Another solution known in the art is the one defined in U.S. Pat. No. 6,756,861. Such a solution would allow the interfacing of orthogonally aligned waveguides with arbitrary offsets. But for a T-shape structure an additional bend has to be integrated into the structure, which increases the size and the unit becomes bulky. It should also be noted, that such a solution in general requires that the twist consists of two parts.

Hence, an improved waveguide junction would be advantageous and in particular one that has good performance characteristics and is easy for manufacturing.

SUMMARY OF THE INVENTION

Accordingly, the invention seeks to preferably mitigate, alleviate, or eliminate one or more of the disadvantages mentioned above singly or in any combination.

According to a first aspect of the present invention, a junction for connecting two waveguides having substantially a 90-degree angular offset between longitudinal symmetry axes of their cross-sections is disclosed. The junction comprises a first interface and a second interface for connecting the waveguides, and further comprises at least a first transformer section and a second transformer section. Both transformer sections have substantially rectangular-shaped cross-sections, and both have the 90-degree angular offset between the longitudinal symmetry axes of their respective cross-sections. The first and the second transformer sections are connected in a way that a T-shape connection is formed. The first transformer section has a first protruded ridge on its broad wall and the second transformer section has a second protruded ridge on its broad wall. The broad wall with the second ridge is connected to the top narrow wall of the first transformer section and the ridges are located such that they overlap.

Alternatively, a junction comprises four transformer sections, two on each side of the junction. A third transformer section is connected to the first transformer section with no angular offset and a fourth transformer section is connected to the second transformer section with no angular offset. The height of the ridges in the third and fourth transformer sections is smaller than height of the ridges in the first and second transformer sections.

Preferably the ridges overlap in their top sections and also preferably the ridges have flat tops.

In one embodiment at least one of the ridges is T-shaped.

In one embodiment, the first interface and the first transformer section are aligned asymmetrically. The narrow wall of the first interface is shifted towards the narrow wall of the first transformer section, which is connected to the broad wall of the second transformer section with the second ridge.

Preferably, the second ridge is located substantially at the center of the broad wall of the second transformer section.

In yet another embodiment, the junction further comprises a first waveguide extension located between the first transformer section and the first interface and a second waveguide extension located between the second transformer section and the second interface.

Further features of the present inventions are as claimed in the dependent claims.

The present invention beneficially allows for the interconnection of waveguides that exhibit an angular offset of 90°—providing compact size, easy manufacturing from one solid block of metal and high performance properties (extremely low VSWR) over broad frequency bands. The junction exhibits no angular offset to the connecting waveguides and consequently there are no problems with any standard flange interconnections (e.g. in sealed waveguide systems). In addition, the length of the manufactured part can be fitted to overall assembly requirements—it no longer depends on the operating frequency band. The T-shape twist is well suited for the implementation in multifeed antenna networks for the adjustment of the polarisation, i.e., the feeds of an existing multifeed array could be equipped with such T-shape twists to serve the orthogonal polarisation.

BRIEF DESCRIPTION OF THE DRAWINGS

The present invention will be understood and appreciated more fully from the following detailed description taken in conjunction with the drawings in which:

FIG. 1 is a schematic diagram illustrating alignment of cross sections of two waveguides to be interconnected (in T-shape configuration) in one embodiment of the present invention;

FIG. 3A and FIG. 3B show the cross sections of the transformer sections in accordance with two alternative embodiments of the present invention in two mirrored configurations;

DETAIL DESCRIPTION OF AN EMBODIMENT OF THE INVENTION

With reference to FIG. 1 and FIGS. 3A-3B, a junction for connecting two waveguides is presented. For the sake of clarity the drawings present the invention in a very schematic way with elements and lines not essential for understanding the invention omitted.

Figure 2:
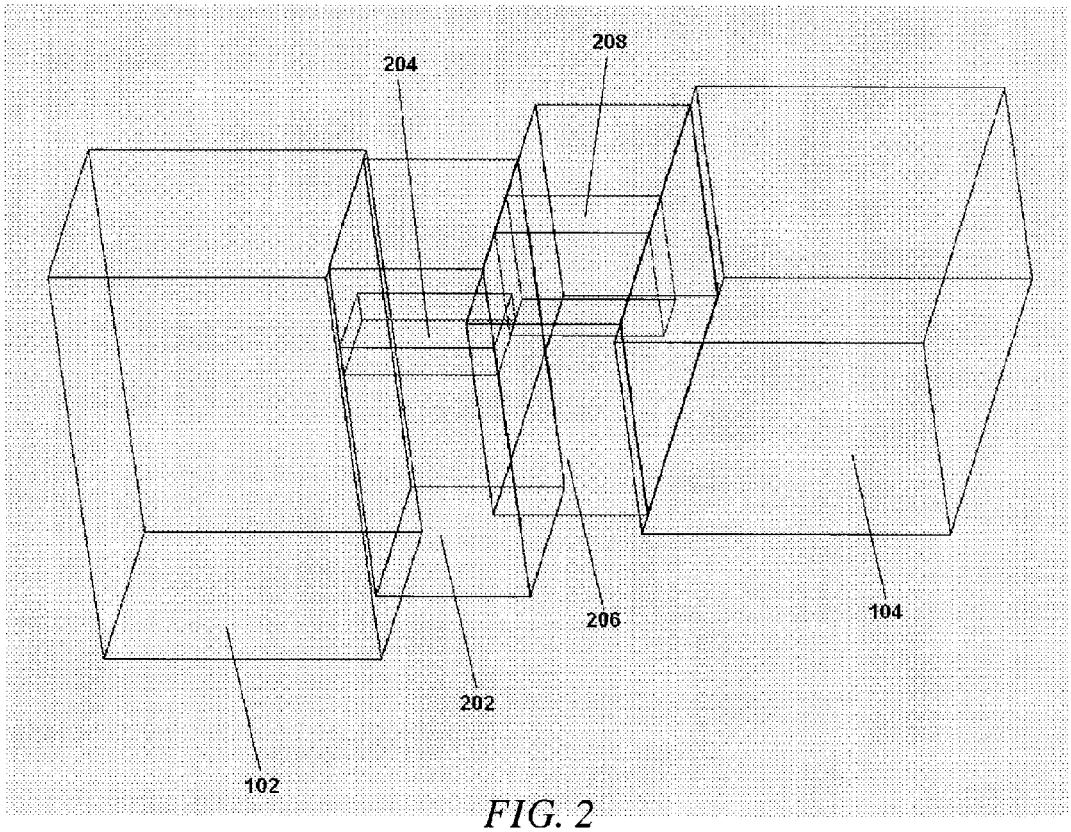
FIG. 2 is a schematic diagram illustrating a junction for connecting two waveguides in accordance with one embodiment of the present invention.

The principle of the invention is depicted in FIG. 1, where a 90° waveguide junction of a T-shape configuration is schematically illustrated by means of cross-sections of a first waveguide 101 and a second waveguide 103. With reference to FIG. 2 a first rectangular waveguide 101 (not shown in FIG. 2) is connected, via a first interface 102, to a first transformer section 202 of the junction. The first transformer section 202 has the same orientation as the first waveguide 101 (i.e., there is no angular offset). Similarly a second rectangular waveguide 103 (not shown in FIG. 2) is connected, via a second interface 104, to a second transformer section 206 of the junction, which has the same orientation as the second waveguide 103. Both the first and the second transformer sections 202 and 206 have cross-sections of substantially rectangular shape, and both have an angular offset between the longitudinal symmetry axes of their cross-sections of 90°. The first transformer section 202 and the second transformer section 206 are connected in a way that a T-shape connection is formed. Each of the transformer sections 202, 206 has one ridge 204 and 208, respectively.

Referring now to FIG. 3A, the interface waveguides 102, 104 with their rectangular cross sections are connected to the first and second waveguide transformer sections 202 and 206, each of which has a single ridge 204 and 208 extending from their broad walls, 210 and 212 respectively, into the rectangular cross section. The first transformer section 202 has a first protruded ridge 204 on one of its broad walls 210 and the second transformer section 206 has a second protruded ridge 208 on its broad wall 212. The broad wall 212 with the second ridge 208 is connected to the narrow wall of the first transformer section 202 and the ridges 204 and 206 are located such that they overlap. FIG. 3A illustrates the succeeding cross sections. The cross sections of the interfaces 102 and 104 are indicated by the dotted lines. The rectangular interface with the vertical alignment (broad walls in parallel to the vertical axis) is connected to the first waveguide transformer section 202 with a smaller cross section that is situated asymmetrically close to the top wall regarding the interface cross section. In addition, the first transformer section 202 has the first ridge 204 extending from one of its broad wails 210 into the transformer section (in FIG. 3 A from the left broad wall). This ridge has an offset from the center location of the cross section towards its top side wall. The second interface 104 with the broad walls aligned horizontally is connected to the second waveguide transformer section 206 with a smaller cross section. The alignment of these two cross sections to each other is almost symmetrical. The second transformer section 206 exhibits the second ridge 208 that extends from the top broad wall 212 into the rectangular cross section almost symmetrical to the vertical axis. First and second transformer sections 202 and 206 are interconnected in the manner of a T-shape, i.e. the top narrow wall of the first transformer section 202 and the top broad wall 212 of the second transformer section 206 are situated close together, where the rectangular cross sections are almost symmetrical to the vertical axis. There is an overlapping of the ridges 204 and 208 of both transformer sections 202 and 206 due to the offset location of the first ridge 204 of the first transformer section 206. The length of both transformer sections 202 and 206 is in the order of a quarter waveguide wavelength of the dedicated ridged cross section. The ridges 204 and 208 yield a field concentration and distortion to obtain the energy transfer between the orthogonal polarizations at the connection of the transformer sections 202 and 206.

The complete 90° offset is realized by the respective 90° angular offset of the first transformer section 202 and the second transformer section 206. In the embodiment presented in FIG. 2 and FIG. 3A the ridges 204 and 208 have flat tops. However, the tops of the ridges 204 and 208 may have different shapes.

In one embodiment, as illustrated on FIG. 3A, the first ridge 204 is located with an offset from the center of the broad wall 210 of the first transformer section 202. The second ridge 208 is located substantially at the center of the broad wall 212 of the second transformer section 206.

In one embodiment, the first interface 102 and the first transformer section 202 are aligned asymmetrically. The narrow wall of the first interface is shifted towards the narrow wall of the first transformer section, which is connected to the broad wall of the second transformer section. The second ridge 208 and the alignment of the second interface 104 and the second transformer section 206 is substantially symmetrical.

In a preferred embodiment the ridges 204, 208 overlap in their top sections.

In an empty rectangular waveguide, the vector of the electric field of the fundamental waveguide mode (TEIO-mode) is always perpendicular to the width (broad dimension) of the waveguide. The same holds for the main component of the electrical field of the fundamental mode in the first and second transformer sections 202, 206 with ridges 204, 208. The twist of the transmitted wave (the change of the direction of the vector of the electric field) builds on a concentration of the electrical field by the ridges 204, 208 at the angular step of 90°. In addition, the electric fields at both sides must have the same field components to obtain an appropriate coupling/transfer of the energy. These prerequisites can be obtained with ridges configured in the transformer sections as proposed in the present invention.

It should be noted that, due to the loading by the ridges 204, 208, the cut-off frequency of the first and second transformer sections 202, 206 is significantly lower than that of a waveguide connections known in the art. This fact allows for significantly shorter transformer sections 202, 206 as compared with the solutions known in the art, i.e., the junction in accordance with the present invention is more compact. However, the invention offers also the possibility to adapt its length to specific requirements, which sometimes would help to avoid additional waveguide hardware. This is obtained in the following way: since the first and second transformer sections 202, 206 have the same orientation as the connected waveguides 101, 103, an additional arbitrary waveguide can be located between the first transformer section 202 and the first interface 102. Similarly an additional waveguide section can be located between the second transformer section 206 and the second interface 104. Alternatively, the length of the interface sections 102 and 104 can be made to meet the dimensional needs of the actual configuration.

Figure 5:
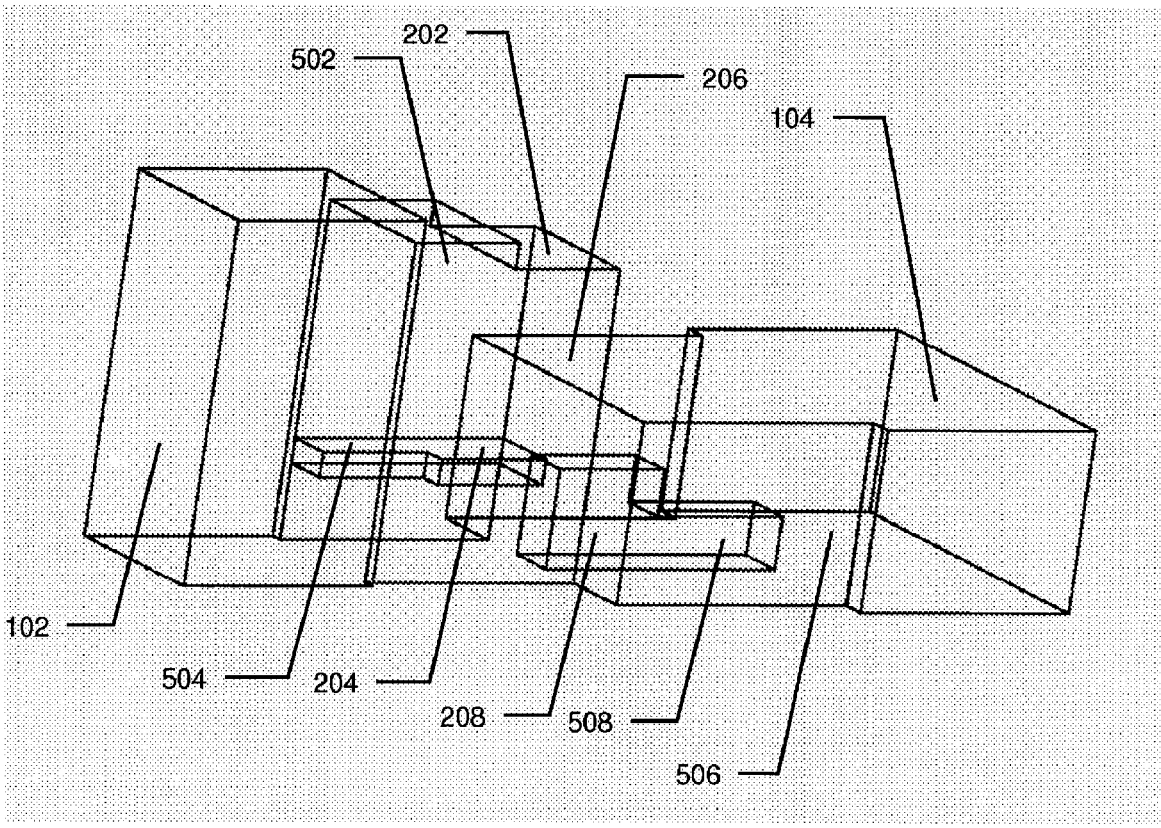
FIG. 5 is a schematic diagram illustrating a junction for connecting two waveguides in accordance with one embodiment of the present invention.

The described structure with two transformer steps is suitable for designs with an operating bandwidth of up to 10% (VSWR e.g. <1.06). In alternative embodiments, for larger bandwidth requirements, additional transformer sections can be considered between the interconnection of the interfaces and the first and second transformer sections 202 and 206 described above. FIG. 5 illustrates an alternative embodiment wherein the first and second interfaces 102, 104 can be seen. In the alternative embodiment of FIG. 5, the junction comprises four transformer sections, two on each side of the junction. A third transformer section 502 is connected to the first transformer section 202, wherein the third and first transformer sections 502, 202 have the same angular orientation. A fourth transformer section 506 is connected to the second transformer section 206. The fourth and second transformer sections 506, 206 have the same angular orientation. The third and fourth transformer sections 502, 506, each of which has one ridge (third ridge 504 and fourth ridge 508, respectively) located substantially in the same places as the first and second ridges 204, 208 of the first and second transformer sections 202, 206. The height of the first 204 and second 208 ridges is larger than that height of the third 504 and fourth 508 ridges, respectively. This results in geometry of the junction that allows for easy manufacturing from one solid block of metal. The second and the fourth transformer sections 206, 506 as illustrated in FIG. 5 have the same dimensions with different dimensions of the ridges only. However, the dimensions of the second 206 and fourth 506 transformer sections 206, 506 can be different as it is in the case of the first transformer section 202 and third transformer section 502 illustrated in FIG. 5. The first transformer section 202 is connected directly to the second transformer section 206 (i.e. the third and fourth transformer sections 502, 506 are the outer ones).

Generally, the transformer sections have the same cross sectional dimensions. Transformation (twisting the orientation of the electric and magnetic vectors of the transmitted wave) is obtained by different dimensions of the ridges of the inner (i.e. third and fourth transformer sections 502, 506), and the outer (i.e. first and second transformer sections 202, 206). The fact that the height of the ridges is, in general, larger (the clearance of the ridges of the inner transformer sections is smaller) in the first and second transformer sections 202 and 206 than in the third and fourth transformer sections 502, 506 maintains the favorable production properties for the junction. However, in alternative embodiments, the third and fourth transformer sections 502, 506 need not have the same overall cross section dimensions as the first and second transformer sections 202, 206. In special designs, a larger cross-section of the third and fourth transformer sections 502, 506 may be used for further performance improvements while allowing for ease of manufacturing.

For antenna feed system applications, especially in multi-feed antennas, the phase orientation may be of particular interest. The introduced novel component design allows, in an alternative embodiment, the transfer of the input signal at one interface to the opposite field orientations at the other interface. This is a transformer structure similar to the one illustrated in FIG. 3A, but mirrored at the vertical axis as illustrated in FIG. 3B. This alternative embodiment of FIG. 3B provides an opposite field orientation (180 degree phase) when compared to the initial field orientation shown in FIG. 3, wherein like features are denoted by the same reference numbers as described with respect to FIG. 3A.

The interfaces are adapted to connect the waveguides 101, 103 in a way that the waveguides 101, 103 also have the same symmetry axis as the sections of the junction. The fact that the junction interfaces always exhibit the same orientation as the waveguides facilitates the implementation of standard sealing means, which are necessary for the application in pressurized waveguide systems.

In alternative embodiments of the present invention, a junction with, e.g., 3 transformer sections is also possible. In such a case, one transformer section would have the same angular alignment as the first interface waveguide and the remaining two would have the angular alignment of the second interface waveguide. The 90° angular offset occurs, then, between the first part of the transformer with one section and the second part with the two sections.

Figure 4:
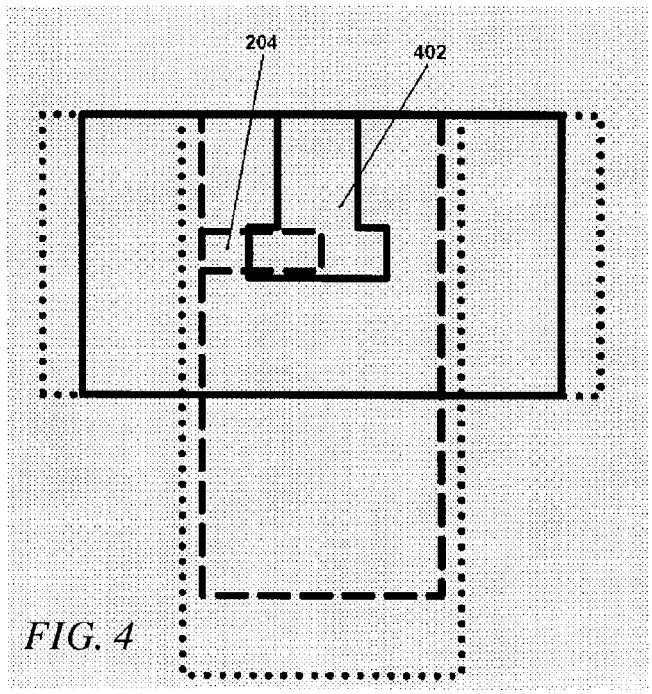
FIG. 4 is a schematic diagram illustrating alignment of two waveguide cross sections to be interconnected (T-shape configuration) in one embodiment of the present invention.

With reference to FIG. 4, an alternative embodiment of the junction is presented. In this alternative embodiment, the first ridge 204 can be seen. At least one of the ridges is T-shaped, 402.

The junction is preferably manufactured from one block of metal in the process of milling it from the flange faces. However, alternative methods of machining can also be used. In principle, the component could easily be diecast from aluminum or even from metalized plastic. When milled, the junction exhibits some radii in the corners of the cross sections. However, complete rectangular shapes that could be a suitable solution for high quantity production by, e.g., diecasting with aluminium or silver-plated plastic, are also possible.

The invention claimed is:

1. A junction for connecting two waveguides having substantially a 90-degree angular offset between longitudinal symmetry axes of their cross-sections, comprising:

a first interface and a second interface, each configured to connect to a respective waveguide; and at least a first transformer section connected to the first interface and having a first protruding ridge on a broad wall, and a second transformer section connected to the second interface and having a second protruding ridge on a broad wall, both transformer sections having substantially rectangular cross-sections, and disposed at a 90-degree angular offset between longitudinal symmetry axes of cross-sections of respective transformer sections;

wherein the first and the second transformer sections are connected to form a T-shape connection such that the broad wall having the second protruding ridge formed thereon is connected to a top narrow wall of the first transformer section.

2. The junction of claim 1 wherein the first protruding ridge is located with an offset from a center of the broad wall of the first transformer section.

3. The junction of claim 1 wherein the cross-sections of the first and second transformer sections are smaller than the cross-sections of the respective first and second interfaces.

4. The junction of claim 1 wherein the first interface and the first transformer section are aligned asymmetrically, and wherein a longitudinal symmetry axis of the first interface is shifted towards a narrow wall of the first transformer section, which is connected to the broad wall of the second transformer section having the second ridge.

5. The junction of claim 1 wherein cross sections of the second interface and the second transformer section are aligned substantially symmetrically relative to each other.

6. The junction of claim 1 wherein the cross-section of the first transformer section has substantially the same dimensions as the cross-section of the second transformer section.

7. The junction of claim 1 wherein the first and second protruding ridges include flat tops.

8. The junction of claim 1 wherein at least one of the first and second protruding ridges is T-shaped.

9. The junction of claim 1 further comprising:

a third transformer section having a third protruding ridge and interposed between the first transformer section and the first interface with no angular offset therebetween; and a fourth transformer section having a fourth protruding ridge and interposed between the second transformer section and the second interface with no angular offset therebetween.

10. The junction of claim 9 wherein the third and fourth protruding ridges have a height that is smaller than a height of the first and second protruding ridges, respectively.

11. The junction of claim 1 wherein the junction is constructed from a monolithic metallic block.

12. The junction of claim 1 wherein the second protruding ridge is located substantially at a center of the broad wall of the second transformer section.

13. The junction of claim 1 wherein the first and second protruding ridges are positioned to overlap.

14. The junction of claim 13 wherein the first and second protruding ridges overlap in sections located opposite ends of the ridges connected to respective transformer sections.

* * * * *

UNITED STATES PATENT AND TRADEMARK OFFICE

CERTIFICATE OF CORRECTION

PATENT NO. : 7,808,337 B2
APPLICATION NO. : 12/094049
DATED : October 5, 2010
INVENTOR(S) : Rosenberg et al.

It is certified that error appears in the above-identified patent and that said Letters Patent is hereby corrected as shown below:

In Column 3, Line 33, delete "DETAIL" and insert -- DETAILED --, therefor.

In Column 4, Line 13, delete "wails" and insert -- walls --, therefor.

In Column 6, Lines 18-19, delete "FIG. 3," and insert -- FIG. 3A, --, therefor.

Signed and Sealed this
Fourth Day of October, 2011

David J. Kappos

David J. Kappos
*Director of the United States Patent and Trademark Office*